US007854825B2

(12) United States Patent
Ebert

(10) Patent No.: US 7,854,825 B2
(45) Date of Patent: Dec. 21, 2010

(54) SYMMETICAL DOUBLE CONTACT ELECTRO-WINNING

(76) Inventor: William Ebert, 15 E. Saguaro, Tucson, AZ (US) 85705

( * ) Notice: Subject to any disclaimer, the term of this patent is extended or adjusted under 35 U.S.C. 154(b) by 563 days.

(21) Appl. No.: 11/998,719

(22) Filed: Dec. 1, 2007

(65) Prior Publication Data

US 2009/0139857 A1 Jun. 4, 2009

(51) Int. Cl.
*C25B 9/04* (2006.01)

(52) U.S. Cl. ..... 204/297.01; 204/279; 204/286.1; 204/278.5

(58) Field of Classification Search ..... 204/279, 204/286.1, 297.01, 267, 288.1, 288.2, 278.5
See application file for complete search history.

(56) References Cited

U.S. PATENT DOCUMENTS

| | | | | |
|---|---|---|---|---|
| 4,479,863 | A * | 10/1984 | Honey et al. | 204/279 |
| 7,204,919 | B2 * | 4/2007 | Dufresne | 204/279 |
| 2009/0152124 | A1 * | 6/2009 | Ashford et al. | 205/574 |

* cited by examiner

*Primary Examiner*—Bruce F Bell
(74) *Attorney, Agent, or Firm*—Mark Ogram

(57) ABSTRACT

A symmetrical double-double contact mechanism for an electro-deposition mechanism. Using a base insulator, a cap block insulator is formed to support four series of electrodes of two different types (anode and cathode). Because of the contact mechanism employed, redundant contacts are provided so that should a short occur, alternative electrical pathways are available to maintain operation of the affected cathode or anode.

20 Claims, 5 Drawing Sheets

SYMMETICAL DOUBLE CONTACT ELECTRO-WINNING

BACKGROUND OF THE INVENTION

This invention relates to mineral extraction through electro-deposition and more particularly to providing electrical contacts for the cathode and anode plates.

In a typical electro-deposition process used for the refining of many minerals including copper, copper is extracted from the ore using starter sheets large metal sheets made of titanium or stainless steel. These sheets are suspended in tanks containing the copper ore, a 5%-10% solution of sulfuric acid, plus other chemicals.

In Solvent Extraction-Electro Winning (SXEW), the copper is leached out of the copper bearing ore using sulfuric acid. The acid containing the copper drains to a collection system (pumps, pipes), ending up in tanks containing the large metal plates.

Low voltage/high amperage direct current electricity is applied, using lead as the anode, and the titanium/stainless steel plate as the cathode. The copper is electro-deposited (plated) on the metal to a pre-determined time/thickness.

This low voltage/high amperage current is typically communicated using simple contacts. That is, the cathode itself rests on the bar providing the electrical current. Since the electrical power provided is low voltage/high amperage, and because of the environment in which the SXEW exists, often there are shorts or failure to make good electrical contact between the current bar and the electrode. This results in no or limited deposition being performed on that cathode.

A variety of techniques have been developed which attempt to cure this "shorting problem" by assuring that contacts are made. One such technique is described in United States Pat. No. 6,342,136, entitled, "Busbar Construction for Electrolytic Cell" issued to Virtanen et al. On Jan. 29, 2002. In this approach, the gap between the electrodes is variable which allows the cathodes to be moved to obtain proper contact. Unfortunately, this is often labor intensive and results in non-optimal placement of the cathodes within the bath.

It is clear from the foregoing that there is a need for a simple to use mechanism which will assure that proper contact with the cathodes is assured.

SUMMARY OF THE INVENTION

The invention creates a symmetrical double-double contact mechanism for an electro-deposition mechanism. This configuration assures that electrical current is conducted to each anode and then into the cathodes, even when a short has occurred in one area to "disconnect" or short one of the anodes or cathode electrodes and relates to the contact mechanism formed between two rows of interspersed anodes and cathodes.

Using a base insulator, a cap block insulator is formed to support four series of electrodes of two different types (anode and cathode). This invention is particularly applicable to for symmetrical systems, that is, where the wings or contacts for the electrodes are substantially the same length.

Because of the contact mechanism employed, redundant connections are provided so that should a short occur for one connection, alternative electrical pathways are available to maintain operation of the affected cathode or anode electrode.

The invention, in this manner, creates an electrical contact mechanism for electrodes (both cathodes and anodes) within an electro-refining mechanism.

A base insulator is used to prevent shorting into the support mechanism. Over the base insulator is a cap block insulator which has four sets of recesses being substantially identical in shape. The recesses are arranged with two sets along one side of the cap block, and two other sets for the opposing side. Each side, in this way, is configured to accept both a series of anodes and an interspersed series of cathodes. Each of the recesses has a hole therethrough which communicates to spaces between the base insulator and the cap block insulator.

Through selected ones of these holes, an electrical connector extends so that one type of electrodes are interconnected. As example, this electrical connector may connect all of the cathodes to each other.

Further, another electrical connector is used to connect all of the opposing type of electrodes along one side of the cap block; and still another electrical connector is used to connect all of the opposing side's electrodes of the opposing type.

In this manner, should a short occur going to one of the electrodes, an alternative electrical pathway is provided to assure that the affected electrode does not go "dormant".

The invention, together with various embodiments thereof, will be more fully explained by the accompanying drawings and the following descriptions thereof.

Drawings in Brief:

Figure 6:
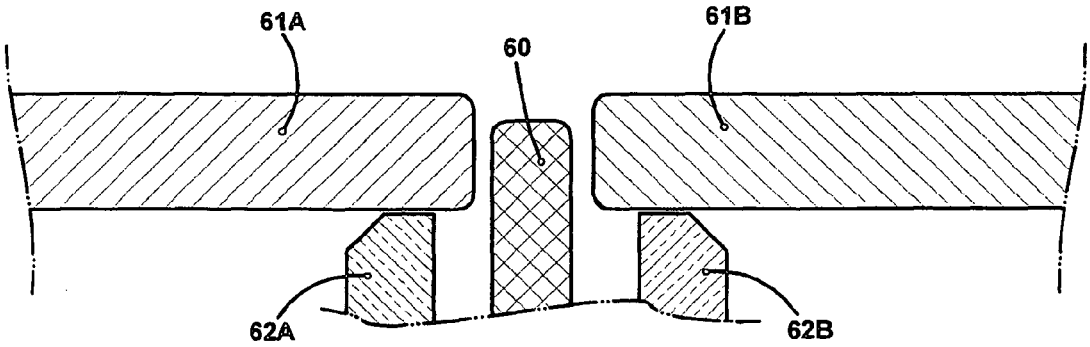

FIG. 6 graphically illustrates the preferred embodiments insulating ridge.

Figure 7A:
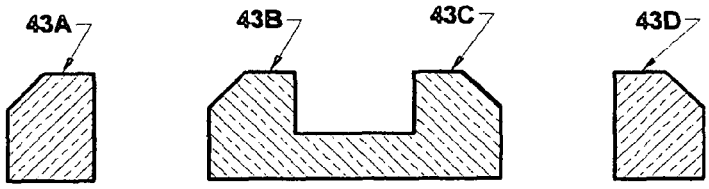
Figure 7B:
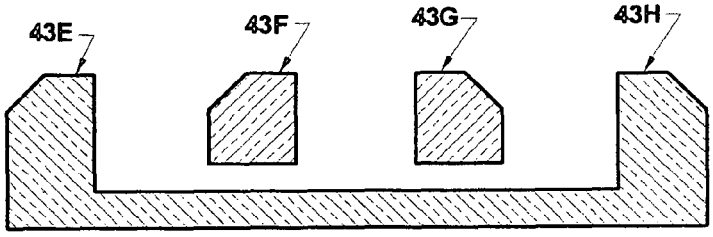

FIGS. 7A and 7B illustrate alternative embodiments for the electrical connection arrangements.

Figure 8A:
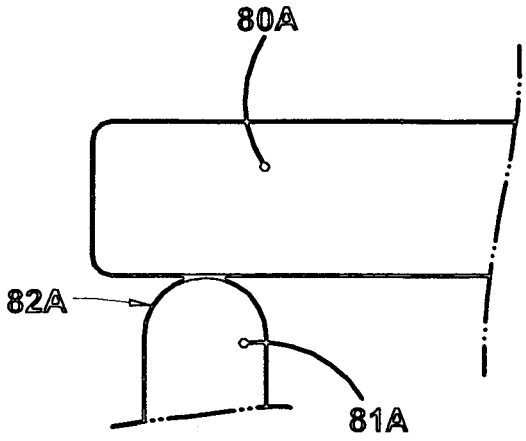
Figure 8B:
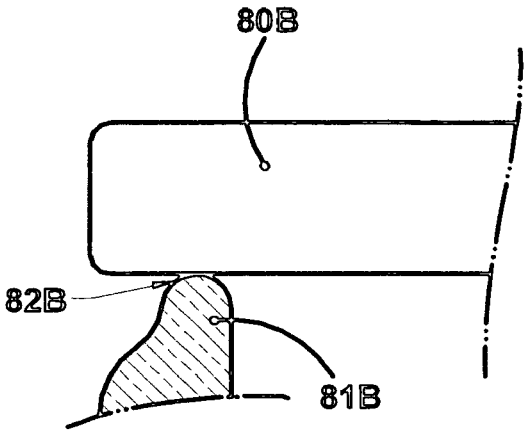
Figure 8C:
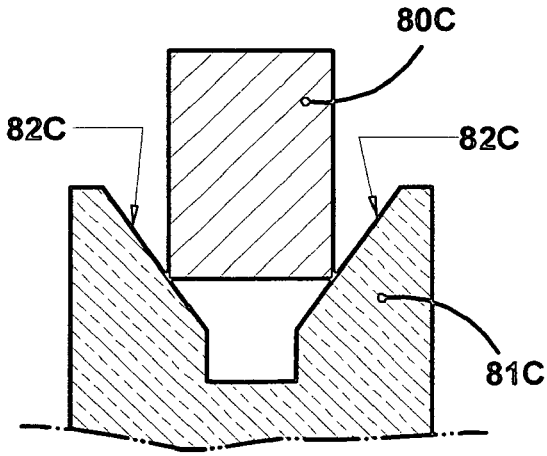

FIGS. 8A, 8B, and 8C illustrate different embodiments for the connection used to engage the electrode contacts.

Figure 1:
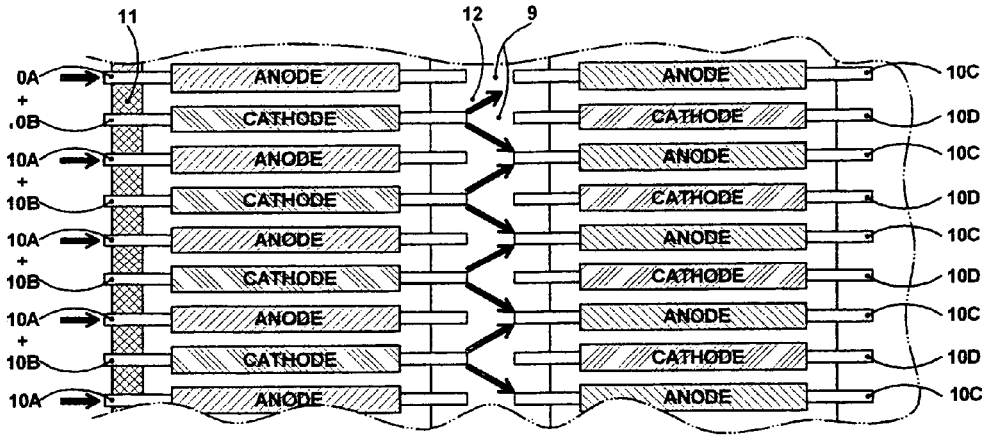
FIG. 1 is a top view of a typical electro-refining mechanism illustrating the placement of the present in invention.

Drawings in Detail:

FIG. 1 is a top view of a typical electro-refining mechanism illustrating the placement of the present in invention.

Within the slurry or bath, four series of electrodes are employed. These four series are formed from two groups, anodes and cathodes. Hence, electrode series 10A and electrode series 10C are of the same type; while electrode series 10B and electrode series 10D are of the opposing type (e.g. anodes in series 10A and 10C; cathodes in series 10B and 10D).

Main bus 11 provides the low voltage/high wattage electrical source to the anodes 10A which then flows through the tank mixture into the cathodes 10B (to cause the electro-deposition), from the cathode 10B, into the anodes 10C, which then communicates the electrical flow into cathode series 10D (again to cause the electro-deposition). This arrangement is repeated many times to create the electro-refining capacity sought at the particular refinery.

Center cap 12 provides for the proper communication of the electrical flow from cathode series 10B to the anode series 10C.

The present invention provides for assurances that should a short/disconnection occurs at one point for any of the electrodes, then an alternative electrical path is available so that deposition always occurs.

Figure 2:
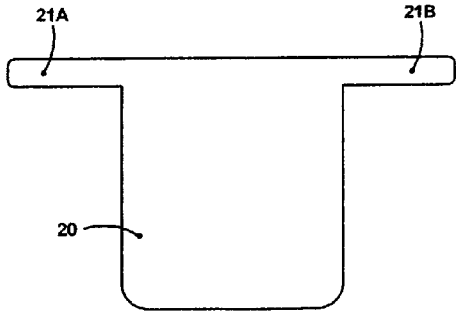
FIG. 2 is a side view of a typical electrode of the present invention.

FIG. 2 is a side view of a typical electrode of the present invention.

The electrodes first described in FIG. 1, have a main body 20 together with two supports/electrical contacts 21A and 21B. It is the electrical contacts 21A and 21B which provide the electrical pathway through the electrode and into/out-of the slurry mixture.

Note, in the present invention, supports/contacts 21A and 21B are substantially the same length. This assists in providing secure placement of the electrode and improved contact capability.

Figure 3:
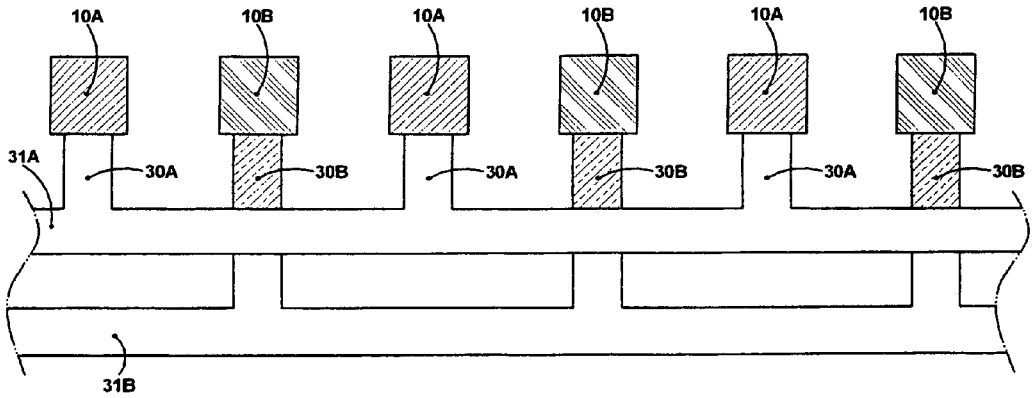
FIG. 3 illustrates the electrical connections along one side of the cap block insulator.

FIG. 3 illustrates the electrical connections along one side of the cap block insulator.

In the cap block illustrated in FIG. 1, electrical connections are made with all four series of electrodes in a particular manner. FIG. 3 illustrates a view from one side illustrating how one embodiment of these connections are arranged.

Supports for electrodes 10A rest on contacts 30A, which are all connected via bus 31A. In like manner, supports for electrodes 10B rest on contacts 30B which are connected via bus 31B. In this manner, the electrical flow is assured to and from each of the series of electrodes.

This illustration places bus 31A and bus 31B at differing levels for clarity of illustration only; but, in the preferred embodiment, the two busses are at substantially the same level and extend parallel to each other.

Cap block 12 (not shown) has the connection illustrated in FIG. 3 extending down both sides of cap block 12. Further, in one embodiment of the invention, a bus from each of the two sides connects the other two busses.

Figure 4A:
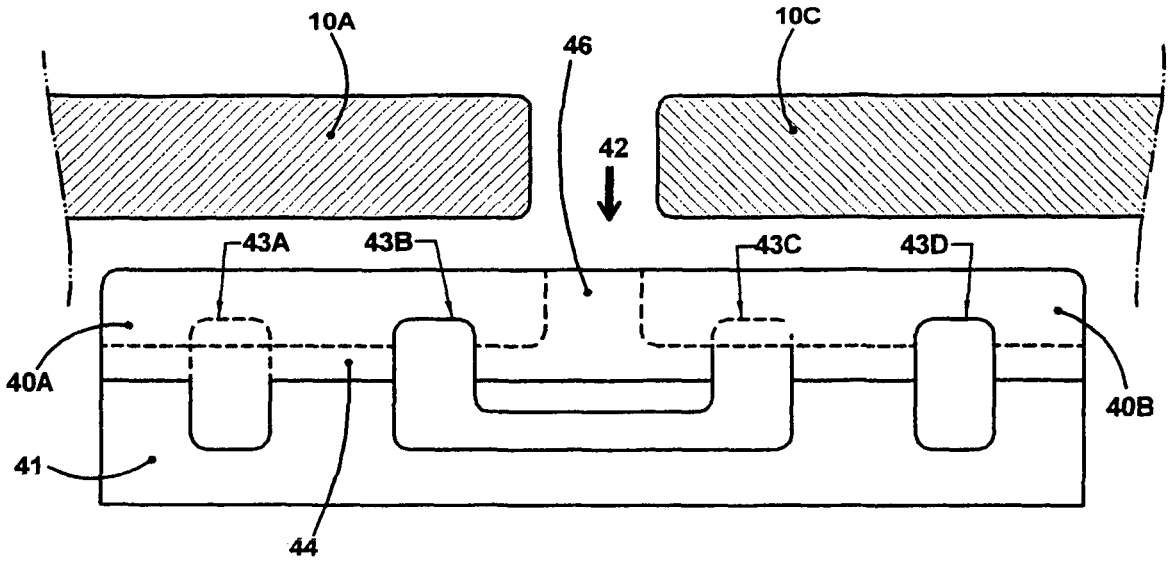
FIGS. 4A and 4B illustrate the preferred embodiment's connection mechanism.
Figure 4B:
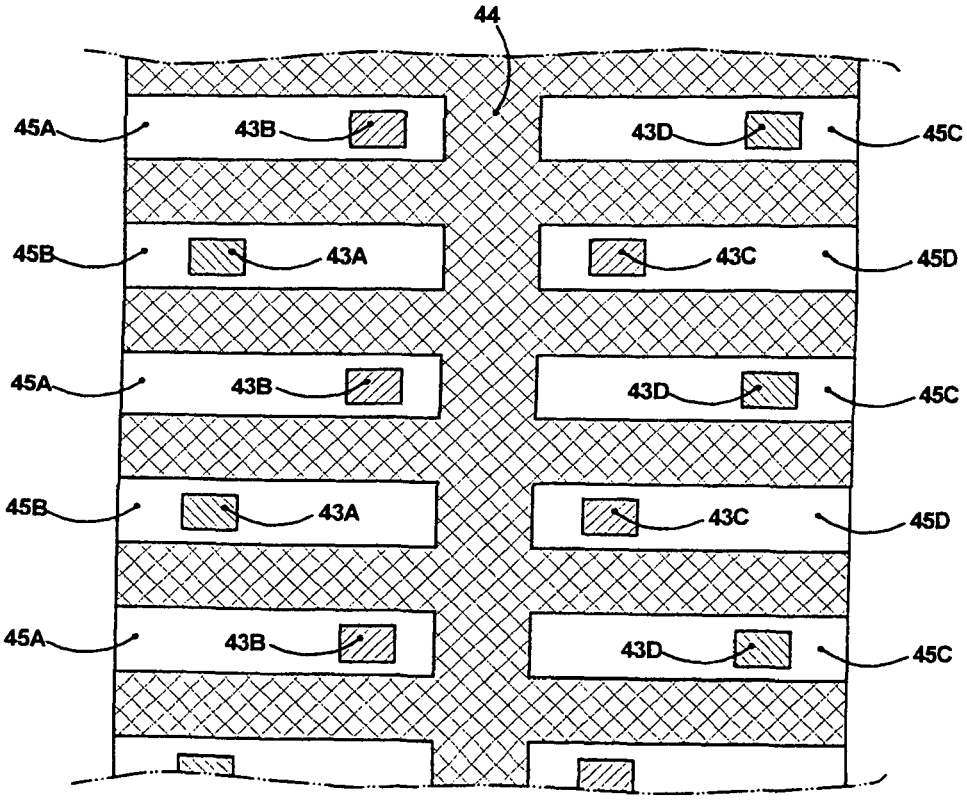

FIGS. 4A and 4B illustrate the preferred embodiment's contact mechanism.

Referencing FIG. 4A, cap block insulator 44 is configured with multiple recesses 40A and 40B (in this view only two of the recesses are visible). Recesses 40A and 40B are configured to accept the electrode contacts from electrodes 10A and 10B as the contacts are lowered as indicated by arrow 42.

Each recess within cap block insulator 44 is provided with an opening which permits an electrical connection to extend therethrough. In this view, electrical connection 43B extends into recess 40A; and electrical connection 43D extends into recess 40B. Electrical connection 43A is positioned into the recess neighboring recess 40A (not visible in this view); and electrical connection 43C is positioned in the recess neighboring recess 40B (not visible in this view). Note that electrical connection 43B and electrical connection 43C are electrically joined so that the electricity can flow from one series of electrode (cathodes) on one side of the cap block the opposite charge electrodes (anodes) on the opposite side of the cap block 44.

In this way, duplicate electrical pathways are created so that it now becomes practically impossible for an electrode to go "dormant" because of a single short.

Ridge 46 between the recesses which prevents the electrode contacts from contacting each other. Ridge 46 runs substantially along the center line of cap block 44.

FIG. 4B is a top view of the cap block illustrating the holes and electrical contacts therein.

Cap block 44 has a series of recesses formed therein to receive the electrical contacts from the electrodes. Four different series of electrodes are accepted by cap block 44. The recesses for these electrode's contacts are the series formed by recesses 45A, recesses 45B, recesses 45C, and recesses 45D.

Each recess has its own opening/hole through which an electrical connector extends. In this illustration, each of the recesses 45A have exposed therein electrical connector 43B; recesses 45B has electrical connector 43A; recesses 45C has electrical connector 43D, and recesses 45D has electrical connector 43C.

As noted above relative to FIG. 4A, electrical connector 43B and 43C are also electrically connected to each other. This electrically connects the electrodes which are placed within recesses 45A with those placed within recesses 45D; thereby providing alternative electrical flow pathways.

The initial current flows from bus 11 into the anode series 10A whereupon the current flows through the tank to the cathode series 10B which then conducts the current (as illustrated by arrows 9) to the anode series 10C on the opposing side of cap block 12; at which point, the cycle continues through the different rows of electrodes.

Figure 4C:
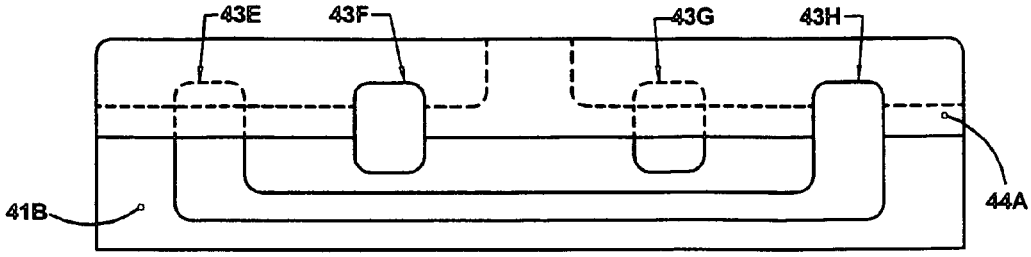
FIG. 4C illustrates an alternative embodiment's connection configuration.

FIG. 4C illustrates an alternative embodiment's connection configuration.

In this embodiment, the cap block 44A and the base insulator 41A are identical to that described before. In this embodiment though, the outer most electrical connector 43E and 43H (being distal from the center line) are interconnected while electrical connector 43F and 43G (the proximal contacts to the center line) are not interconnected.

Figure 5A:
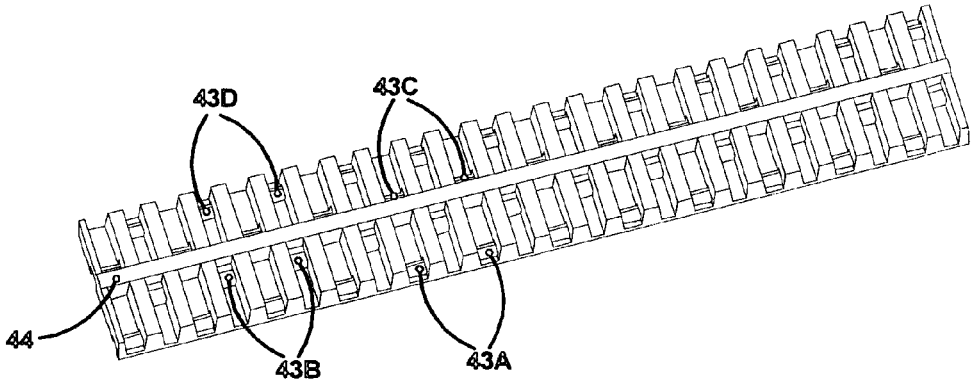
FIG. 5A is a perspective view of the preferred cap block insulator.

FIG. 5A is a perspective view of the preferred cap block insulator.

As described earlier, cap block 44 is equipped with a series of recesses along each of its side. Each recesses having an opening therein through which an electrical connector extends, as noted by 43A, 43B, 43C, and 43D.

Figure 5B:
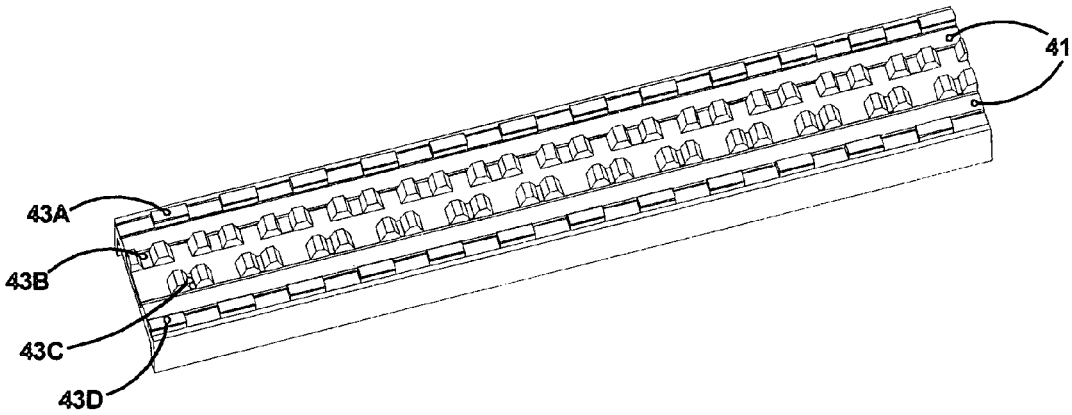
FIG. 5B illustrates the electrical connection on the base insulator.

FIG. 5B illustrates the placement of the electrical connector on the base insulator which is then covered by the cap block insulator shown in FIG. 5A.

Base insulator 41 has placed on it, three different connecting strips extend the length of base insulator 41. In this illustration, the electrical connectors 43A are formed on a single electrical strip; in like fashion, electrical connectors 43D are also formed on a single electrical strip.

Electrical contacts 43B and 43C are also formed on a common electrical strip to provide the redundant pathway sought.

FIG. 6 graphically illustrates the preferred embodiments insulating ridge.

Insulating ridge 60, extends down the center of the cap block and is designed to maintain electrode 61A from contacting electrode 61B since they are of opposite polarity. Note that electrode 61A makes contact with electrical connector 62A by resting thereon; and, electrode 61B rests on electrical connector 62B.

FIGS. 7A and 7B illustrate alternative embodiments for the electrical connector arrangements.

Referring to FIG. 7A, in this embodiment, connector 43B and 43C are in contact while electrical connector 43A and 43D are not.

In FIG. 7B, connector 43E and 43H are interconnected while connector 43F and 43G are not.

FIGS. 8A, 8B, and 8C illustrate different embodiments for the connectors used to engage the electrode contacts.

FIG. 8A is a side view of one embodiment of the connector arrangement. As noted earlier, electrode contact 80A makes contact with the electrical connector 81A by resting thereon. In this embodiment, the top 82A of electrical connector 81A is rounded.

In FIG. 8B, a side view of another embodiment of the connector arrangement, electrode contact 80B makes contact with the electrical connector 81B by resting thereon. In this embodiment, the top 82B of electrical connector 81B is angled.

FIG. 8C is an end view of yet another embodiment of the invention. As with the others, electrode contact 80C makes contact with the electrical connector 81C by resting therein because, in this embodiment, electrical connector 81C is "V" shaped (82C) which provides enhanced electrical contact between the electrical connector and the electrode.

It is clear that the present invention's contact mechanism creates a highly improved electro-deposition mechanism.

What is claimed is:

1. An electrical contact mechanism for cathodes and anodes within an electro-refining mechanism comprising:

a) a base insulator;

b) a cap block insulator having, 1) a first set of recesses on a first side of said cap block insulator, each of said first set of recesses having an opening through said cap block insulator, 2) a second set of recesses on the first side of said cap block insulator, each of said second set of recesses having an opening through said cap block, 3) a third set of recesses on an opposing second side of said cap block insulator, each of said third set of recesses having an opening through said cap block, 4) a fourth set of recesses on the second side of said cap block insulator, each of said fourth set of recesses having an opening through said cap block, 5) an insulating ridge positioned substantially along a center line of said cap block insulator and configured to electrically separate said first and second set of recesses from the third and fourth set of recesses, c) a first electrical connector extending through the openings in the first set of recesses and the openings in the third set of recesses;

d) a second electrical connector extending through the openings in the second set of recesses; and, e) a third electrical connector extending through the openings in the fourth set of recesses.

2. The electrical contact mechanism according to claim 1, wherein, a) the openings in said first series of openings are positioned proximate to the insulating ridge;

b) the openings in said second series of openings are positioned distal to the insulating ridge; and, c) the openings in said third series of openings are positioned distal to the insulating ridge.

3. The electrical contact mechanism according to claim 1, wherein, a) the openings in said first series of openings are positioned distal to the insulating ridge;

b) the openings in said second series of openings are positioned proximate to the insulating ridge; and, c) the openings in said third series of openings are positioned proximate to the insulating ridge.

4. The electrical contact mechanism according to claim 2, wherein a) an upper surface of the first electrical connector extending through the openings in the first set of recesses and the third set of recesses are rounded;

b) an upper surface of the second electrical connector extending through the openings in the second set of recesses are rounded; and, c) an upper surface of the third electrical connector extending through the openings in the third set of recesses are rounded.

5. The electrical contact mechanism according to claim 2, wherein:

a) an upper surface of the first electrical connector extending through the openings in the first set of recesses and the third set of recesses are flat;

b) an upper surface of the second electrical connector extending through the openings in the second set of recesses are flat; and, c) an upper surface of the third electrical connector extending through the openings in the third set of recesses are flat.

6. The electrical contact mechanism according to claim 2, wherein:

a) an upper surface of the first electrical connector extending through the openings in the first set of recesses and the third set of recesses are "V" shaped;

b) an upper surface of the second electrical connector extending through the openings in the second set of recesses are "V" shaped; and, c) an upper surface of the third electrical connector extending through the openings in the third set of recesses are "V" shaped.

7. An electro-deposition mechanism comprising:

a) a base insulator;

b) a first and second series of electrodes of a first type, each of said electrodes in the first and second series of electrodes having two electrical contacts adapted to support the electrode;

c) a third and fourth series of electrodes of an opposing second type, each of said electrodes in the third and fourth series having two electrical contacts adapted to support the electrode;

d) a cap block insulator having, 1) a first set of recesses on a first side of said cap block insulator, each of said first set of recesses having an opening through said cap block insulator and adapted to receive one of the electrodes in the first series of electrodes, 2) a second set of recesses on the first side of said cap block insulator, each of said second set of recesses having an opening through said cap block and adapted to receive one of the electrodes in the second series of electrodes, 3) a third set of recesses on an opposing second side of said cap block insulator, each of said third set of recesses having an opening through said cap block and adapted to receive one of the electrodes in the third series of electrodes, 4) a fourth set of recesses on the second side of said cap block insulator, each of said fourth set of recesses having an opening through said cap block and adapted to receive one of the electrodes in the fourth series of electrodes, 5) an insulating ridge positioned substantially along a center line of said cap block insulator and configured to electrically separate the first and second set of recesses from the third and fourth set of recesses, e) a first electrical connector extending through the openings in the first set of recesses and the openings in the third set of recesses;

f) a second electrical connector extending through the openings in the second set of recesses; and, g) a third electrical connector extending through the openings in the fourth set of recesses.

8. The electro-deposition mechanism according to claim 7, wherein all of the electrical contacts for each electrode within the first, second, third, and fourth series, are substantially the same length.

9. The electro-deposition mechanism according to claim 8, wherein the contacts for each electrode in the first, second, third and fourth series of electrodes are substantially equal in length.

10. The electro-deposition mechanism according to claim 8, wherein, a) the openings in said first series of openings are positioned proximate to the insulating ridge;

b) the openings in said second series of openings are positioned distal to the insulating ridge; and, c) the openings in said third series of openings are positioned distal to the insulating ridge.

11. The electro-deposition mechanism according to claim 8, wherein, a) the openings in said first series of openings are positioned distal to the insulating ridge;

b) the openings in said second series of openings are positioned proximate to the insulating ridge; and, c) the openings in said third series of openings are positioned proximate to the insulating ridge.

12. The electro-deposition mechanism according to claim 11, wherein:

a) an upper surface of the first electrical connector extending through the openings in the first set of recesses and the third set of recesses and upon which electrodes rest and contact, are rounded;

b) an upper surface of the second electrical connector extending through the openings in the second set of recesses and upon which electrodes rest and contact, are rounded; and, c) an upper surface of the third electrical connector extending through the openings in the third set of recesses upon which electrodes rest and contact, are rounded.

13. The electro-deposition mechanism according to claim 11, wherein:

a) an upper surface of the first electrical connector extending through the openings in the first set of recesses and the third set of recesses upon which electrodes rest and contact, are flat;

b) an upper surface of the second electrical connector extending through the openings in the second set of recesses upon which electrodes rest and contact, are flat; and, c) an upper surface of the third electrical connector extending through the openings in the third set of recesses upon which electrodes rest and contact, are flat.

14. The electro-deposition mechanism according to claim 11, wherein a) an upper surface of the first electrical connector extending through the openings in the first set of recesses and the third set of recesses upon which electrodes rest and contact, are "V" shaped;

b) an upper surface of the second electrical connector extending through the openings in the second set of recesses upon which electrodes rest and contact, are "V" shaped; and, c) an upper surface of the third electrical connector extending through the openings in the third set of recesses upon which electrodes rest and contact, are "V" shaped.

15. A mechanism for providing electrical energy to four series of electrodes comprising:

a) a cap block insulator having, 1) a first set of recesses on a first side of said cap block insulator, each of said first set of recesses having an opening through said cap block insulator, 2) a second set of recesses on the first side of said cap block insulator, each of said second set of recesses having an opening through said cap block, 3) a third set of recesses on an opposing second side of said cap block insulator, each of said third set of recesses having an opening through said cap block, 4) a fourth set of recesses on the second side of said cap block insulator, each of said fourth set of recesses having an opening through said cap block, 5) an insulating ridge positioned substantially along a center line of said cap block insulator and configured to electrically separate said first and second set of recesses from the third and fourth set of recesses, b) a first electrical connector extending through the openings in the first set of recesses and the openings in the third set of recesses;

c) a second electrical connector extending through the openings in the second set of recesses; and, d) a third electrical connector extending through the openings in the fourth set of recesses.

16. The mechanism according to claim 15, wherein, a) the openings in said first series of openings are positioned proximate to the insulating ridge;

b) the openings in said second series of openings are positioned distal to the insulating ridge; and, c) the openings in said third series of openings are positioned distal to the insulating ridge.

17. The mechanism according to claim 15, wherein, a) the openings in said first series of openings are positioned distal to the insulating ridge;

b) the openings in said second series of openings are positioned proximate to the insulating ridge; and, c) the openings in said third series of openings are positioned proximate to the insulating ridge.

18. The mechanism according to claim 16, wherein:

a) an upper surface of the first electrical connector extending through the openings in the first set of recesses and the third set of recesses are rounded;

b) an upper surface of the second electrical connector extending through the openings in the second set of recesses are rounded; and, c) an upper surface of the third electrical connector extending through the openings in the third set of recesses are rounded.

19. The mechanism according to claim 16, wherein:

a) an upper surface of the first electrical connector extending through the openings in the first set of recesses and the third set of recesses are flat;

b) an upper surface of the second electrical connector extending through the openings in the second set of recesses are flat; and, c) an upper surface of the third electrical connector extending through the openings in the third set of recesses are flat.

20. The mechanism according to claim 16, wherein:

a) an upper surface of the first electrical connector extending through the openings in the first set of recesses and the third set of recesses are "V" shaped;

b) an upper surface of the second electrical connector extending through the openings in the second set of recesses are "V" shaped; and, c) an upper surface of the third electrical connector extending through the openings in the third set of recesses are "V" shaped.

* * * * *